US007787810B2

(12) United States Patent
Kerxhalli et al.

(10) Patent No.: US 7,787,810 B2
(45) Date of Patent: Aug. 31, 2010

(54) ACTIVE STATION ADAPTIVE IMAGE REGISTRATION

(75) Inventors: David M. Kerxhalli, Rochester, NY (US); Thomas M. Baretsky, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 629 days.

(21) Appl. No.: 11/881,588

(22) Filed: Jul. 27, 2007

(65) Prior Publication Data

US 2009/0028614 A1 Jan. 29, 2009

(51) Int. Cl.
*G03G 15/01* (2006.01)

(52) U.S. Cl. ..... 399/301; 399/49; 399/72; 347/116

(58) Field of Classification Search ..... 399/49, 399/72, 301; 347/116
See application file for complete search history.

(56) References Cited

U.S. PATENT DOCUMENTS

| | | | | |
|---|---|---|---|---|
| 6,275,244 | B1 | 8/2001 | Omelchenko et al. | 346/116 |
| 6,300,968 | B1 | 10/2001 | Kerxhalli et al. | 347/116 |
| 6,493,011 | B1 | 12/2002 | Shioya | 347/116 |
| 6,526,240 | B1 | 2/2003 | Thomas et al. | 399/72 |
| 6,639,669 | B2 | 10/2003 | Hubble, III et al. | 356/319 |
| 6,667,756 | B2 | 12/2003 | Conrow et al. | 347/248 |
| 6,763,199 | B2 | 7/2004 | Conrow et al. | 399/15 |
| 6,806,896 | B2 | 10/2004 | Conrow et al. | 347/248 |
| 6,903,758 | B1 | 6/2005 | Kerxhalli et al. | 347/116 |
| 7,039,348 | B2 | 5/2006 | Kerxhalli et al. | 399/301 |
| 7,071,956 | B2 | 7/2006 | Conrow et al. | 347/116 |
| 2003/0128401 | A1 | 7/2003 | Conrow et al. | 358/300 |
| 2003/0133000 | A1 | 7/2003 | Conrow et al. | 347/116 |
| 2004/0036847 | A1 | 2/2004 | Conrow et al. | 355/24 |
| 2004/0114025 | A1 | 6/2004 | Kerxhalli et al. | 347/232 |
| 2007/0053727 | A1* | 3/2007 | Goto | 399/301 |

* cited by examiner

*Primary Examiner*—David M Gray
*Assistant Examiner*—Ryan D Walsh
(74) *Attorney, Agent, or Firm*—Kermit D. Lopez; Luis M. Ortiz; Ortiz & Lopez, PLLC

(57) ABSTRACT

A color registration method, system, and computer program product generally includes a plurality of imaging stations and one or more MOB (Marks-On Belt) sensors. An indication is initially provided to each imaging station among the imaging stations, which colors among a plurality of colors associated with said color registration system are active. Next, an arbitrary imaging station among the imaging stations can be assigned as a reference color. Thereafter, the arbitrary imaging station can be instructed to write an appropriate color pattern to replace marks associated with any imaging among imaging stations not enabled with the marks with respect to said reference color in order to thereby produce a resulting color ensemble that is detectable by one or more MOB sensors.

18 Claims, 9 Drawing Sheets

700

| Physical Station Activity | | | | | | |
|---|---|---|---|---|---|---|
| | PK | PA | PB | PC | PD | PE |
| 1 | Active | Active | Active | Active | Active | Active |
| 2 | Active | Active | Active | Active | Active | (off) |
| 3 | Active | Active | Active | Active | (off) | Active |
| 4 | Active | Active | Active | Active | (off) | (off) |
| 5 | Active | Active | Active | (off) | Active | Active |
| 6 | Active | Active | Active | (off) | Active | (off) |
| 7 | Active | Active | Active | (off) | (off) | Active |
| 8 | Active | Active | Active | (off) | (off) | (off) |
| 9 | Active | Active | (off) | Active | Active | Active |
| 10 | Active | Active | (off) | Active | Active | (off) |
| 11 | Active | Active | (off) | Active | (off) | Active |
| 12 | Active | Active | (off) | Active | (off) | (off) |
| 13 | Active | Active | (off) | (off) | Active | Active |
| 14 | Active | Active | (off) | (off) | Active | (off) |
| 15 | Active | Active | (off) | (off) | (off) | Active |
| 16 | Active | Active | (off) | (off) | (off) | (off) |
| 17 | Active | (off) | Active | Active | Active | Active |
| 18 | Active | (off) | Active | Active | Active | (off) |
| 19 | Active | (off) | Active | Active | (off) | Active |
| 20 | Active | (off) | Active | Active | (off) | (off) |
| 21 | Active | (off) | Active | (off) | Active | Active |
| 22 | Active | (off) | Active | (off) | Active | (off) |
| 23 | Active | (off) | Active | (off) | (off) | Active |
| 24 | Active | (off) | Active | (off) | (off) | (off) |
| 25 | Active | (off) | (off) | Active | Active | Active |
| 26 | Active | (off) | (off) | Active | Active | (off) |
| 27 | Active | (off) | (off) | Active | (off) | Active |
| 28 | Active | (off) | (off) | Active | (off) | (off) |
| 29 | Active | (off) | (off) | (off) | Active | Active |
| 30 | Active | (off) | (off) | (off) | Active | (off) |
| 31 | Active | (off) | (off) | (off) | (off) | Active |
| 32 | Active | (off) | (off) | (off) | (off) | (off) |

| Physical Station Activity | | | | | | |
|---|---|---|---|---|---|---|
| | PK | PA | PB | PC | PD | PE |
| 33 | (off) | Active | Active | Active | Active | Active |
| 34 | (off) | Active | Active | Active | Active | (off) |
| 35 | (off) | Active | Active | Active | (off) | Active |
| 36 | (off) | Active | Active | Active | (off) | (off) |
| 37 | (off) | Active | Active | (off) | Active | Active |
| 38 | (off) | Active | Active | (off) | Active | (off) |
| 39 | (off) | Active | Active | (off) | (off) | Active |
| 40 | (off) | Active | Active | (off) | (off) | (off) |
| 41 | (off) | Active | (off) | Active | Active | Active |
| 42 | (off) | Active | (off) | Active | Active | (off) |
| 43 | (off) | Active | (off) | Active | (off) | Active |
| 44 | (off) | Active | (off) | Active | (off) | (off) |
| 45 | (off) | Active | (off) | (off) | Active | Active |
| 46 | (off) | Active | (off) | (off) | Active | (off) |
| 47 | (off) | Active | (off) | (off) | (off) | Active |
| 48 | (off) | Active | (off) | (off) | (off) | (off) |
| 49 | (off) | (off) | Active | Active | Active | Active |
| 50 | (off) | (off) | Active | Active | Active | (off) |
| 51 | (off) | (off) | Active | Active | (off) | Active |
| 52 | (off) | (off) | Active | Active | (off) | (off) |
| 53 | (off) | (off) | Active | (off) | Active | Active |
| 54 | (off) | (off) | Active | (off) | Active | (off) |
| 55 | (off) | (off) | Active | (off) | (off) | Active |
| 56 | (off) | (off) | Active | (off) | (off) | (off) |
| 57 | (off) | (off) | (off) | Active | Active | Active |
| 58 | (off) | (off) | (off) | Active | Active | (off) |
| 59 | (off) | (off) | (off) | Active | (off) | Active |
| 60 | (off) | (off) | (off) | Active | (off) | (off) |
| 61 | (off) | (off) | (off) | (off) | Active | Active |
| 62 | (off) | (off) | (off) | (off) | Active | (off) |
| 63 | (off) | (off) | (off) | (off) | (off) | Active |

FIG. 7

800

| Active / Physical Station Activity | | | | | | |
|---|---|---|---|---|---|---|
| | PK | PA | PB | PC | PD | PE |
| 1 | AK | A1 | A2 | A3 | A4 | A5 |
| 2 | AK | A1 | A2 | A3 | A4 | (off) |
| 3 | AK | A1 | A2 | A3 | (off) | A4 |
| 4 | AK | A1 | A2 | A3 | (off) | (off) |
| 5 | AK | A1 | A2 | (off) | A3 | A4 |
| 6 | AK | A1 | A2 | (off) | A3 | (off) |
| 7 | AK | A1 | A2 | (off) | (off) | A3 |
| 8 | AK | A1 | A2 | (off) | (off) | (off) |
| 9 | AK | A1 | (off) | A2 | A3 | A4 |
| 10 | AK | A1 | (off) | A2 | A3 | (off) |
| 11 | AK | A1 | (off) | A2 | (off) | A3 |
| 12 | AK | A1 | (off) | A2 | (off) | (off) |
| 13 | AK | A1 | (off) | (off) | A2 | A3 |
| 14 | AK | A1 | (off) | (off) | A2 | (off) |
| 15 | AK | A1 | (off) | (off) | (off) | A2 |
| 16 | AK | A1 | (off) | (off) | (off) | (off) |
| 17 | AK | (off) | A1 | A2 | A3 | A4 |
| 18 | AK | (off) | A1 | A2 | A3 | (off) |
| 19 | AK | (off) | A1 | A2 | (off) | A3 |
| 20 | AK | (off) | A1 | A2 | (off) | (off) |
| 21 | AK | (off) | A1 | (off) | A2 | A3 |
| 22 | AK | (off) | A1 | (off) | A2 | (off) |
| 23 | AK | (off) | A1 | (off) | (off) | A2 |
| 24 | AK | (off) | A1 | (off) | (off) | (off) |
| 25 | AK | (off) | (off) | A1 | A2 | A3 |
| 26 | AK | (off) | (off) | A1 | A2 | (off) |
| 27 | AK | (off) | (off) | A1 | (off) | A2 |
| 28 | AK | (off) | (off) | A1 | (off) | (off) |
| 29 | AK | (off) | (off) | (off) | A1 | A2 |
| 30 | AK | (off) | (off) | (off) | A1 | (off) |
| 31 | AK | (off) | (off) | (off) | (off) | A1 |
| 32 | AK | (off) | (off) | (off) | (off) | (off) |

| Active / Physical Station Activity | | | | | | |
|---|---|---|---|---|---|---|
| | PK | PA | PB | PC | PD | PE |
| 33 | (off) | A1 | A2 | A3 | A4 | A5 |
| 34 | (off) | A1 | A2 | A3 | A4 | (off) |
| 35 | (off) | A1 | A2 | A3 | (off) | A4 |
| 36 | (off) | A1 | A2 | A3 | (off) | (off) |
| 37 | (off) | A1 | A2 | (off) | A3 | A4 |
| 38 | (off) | A1 | A2 | (off) | A3 | (off) |
| 39 | (off) | A1 | A2 | (off) | (off) | A3 |
| 40 | (off) | A1 | A2 | (off) | (off) | (off) |
| 41 | (off) | A1 | (off) | A2 | A3 | A4 |
| 42 | (off) | A1 | (off) | A2 | A3 | (off) |
| 43 | (off) | A1 | (off) | A2 | (off) | A3 |
| 44 | (off) | A1 | (off) | A2 | (off) | (off) |
| 45 | (off) | A1 | (off) | (off) | A2 | A3 |
| 46 | (off) | A1 | (off) | (off) | A2 | (off) |
| 47 | (off) | A1 | (off) | (off) | (off) | A2 |
| 48 | (off) | A1 | (off) | (off) | (off) | (off) |
| 49 | (off) | (off) | A1 | A2 | A3 | A4 |
| 50 | (off) | (off) | A1 | A2 | A3 | (off) |
| 51 | (off) | (off) | A1 | A2 | (off) | A3 |
| 52 | (off) | (off) | A1 | A2 | (off) | (off) |
| 53 | (off) | (off) | A1 | (off) | A2 | A3 |
| 54 | (off) | (off) | A1 | (off) | A2 | (off) |
| 55 | (off) | (off) | A1 | (off) | (off) | A2 |
| 56 | (off) | (off) | A1 | (off) | (off) | (off) |
| 57 | (off) | (off) | (off) | A1 | A2 | A3 |
| 58 | (off) | (off) | (off) | A1 | A2 | (off) |
| 59 | (off) | (off) | (off) | A1 | (off) | A2 |
| 60 | (off) | (off) | (off) | A1 | (off) | (off) |
| 61 | (off) | (off) | (off) | (off) | A1 | A2 |
| 62 | (off) | (off) | (off) | (off) | A1 | (off) |
| 63 | (off) | (off) | (off) | (off) | (off) | A1 |

FIG. 8

900

| Chevrons for Active Stations ("none" = = "don't care") | | | | | | |
|---|---|---|---|---|---|---|
| | AK | A1 | A2 | A3 | A4 | A5 |
| 1 | Std AK | Ref K + Qty 5 | Std A2 | Std A3 | Std A4 | Std A5 |
| 2 | Std AK | Ref K + Qty 4 | Std A2 | Std A3 | Std A4 | (none) |
| 3 | Std AK | Ref K + Qty 4 | Std A2 | Std A3 | Std A4 | (none) |
| 4 | Std AK | Ref K + Qty 3 | Std A2 | Std A3 | (none) | (none) |
| 5 | Std AK | Ref K + Qty 4 | Std A2 | Std A3 | Std A4 | (none) |
| 6 | Std AK | Ref K + Qty 3 | Std A2 | Std A3 | (none) | (none) |
| 7 | Std AK | Ref K + Qty 3 | Std A2 | Std A3 | (none) | (none) |
| 8 | Std AK | Ref K + Qty 2 | Std A2 | (none) | (none) | (none) |
| 9 | Std AK | Ref K + Qty 4 | Std A2 | Std A3 | Std A4 | (none) |
| 10 | Std AK | Ref K + Qty 3 | Std A2 | Std A3 | (none) | (none) |
| 11 | Std AK | Ref K + Qty 3 | Std A2 | Std A3 | (none) | (none) |
| 12 | Std AK | Ref K + Qty 2 | Std A2 | (none) | (none) | (none) |
| 13 | Std AK | Ref K + Qty 3 | Std A2 | Std A3 | (none) | (none) |
| 14 | Std AK | Ref K + Qty 2 | Std A2 | (none) | (none) | (none) |
| 15 | Std AK | Ref K + Qty 2 | Std A2 | (none) | (none) | (none) |
| 16 | Std AK | Ref K + Qty 1 | (none) | (none) | (none) | (none) |
| 17 | Std AK | Ref K + Qty 4 | Std A2 | Std A3 | Std A4 | (none) |
| 18 | Std AK | Ref K + Qty 3 | Std A2 | Std A3 | (none) | (none) |
| 19 | Std AK | Ref K + Qty 3 | Std A2 | Std A3 | (none) | (none) |
| 20 | Std AK | Ref K + Qty 2 | Std A2 | (none) | (none) | (none) |
| 21 | Std AK | Ref K + Qty 3 | Std A2 | Std A3 | (none) | (none) |
| 22 | Std AK | Ref K + Qty 2 | Std A2 | (none) | (none) | (none) |
| 23 | Std AK | Ref K + Qty 2 | Std A2 | (none) | (none) | (none) |
| 24 | Std AK | Ref K + Qty 1 | (none) | (none) | (none) | (none) |
| 25 | Std AK | Ref K + Qty 3 | Std A2 | Std A3 | (none) | (none) |
| 26 | Std AK | Ref K + Qty 2 | Std A2 | (none) | (none) | (none) |
| 27 | Std AK | Ref K + Qty 2 | Std A2 | (none) | (none) | (none) |
| 28 | Std AK | Ref K + Qty 1 | (none) | (none) | (none) | (none) |
| 29 | Std AK | Ref K + Qty 2 | Std A2 | (none) | (none) | (none) |
| 30 | Std AK | Ref K + Qty 1 | (none) | (none) | (none) | (none) |
| 31 | Std AK | Ref K + Qty 1 | (none) | (none) | (none) | (none) |
| 32 | (none) | (none) | (none) | (none) | (none) | (none) |

| Chevrons for Active Stations ("none" = = "don't care") | | | | | | |
|---|---|---|---|---|---|---|
| | AK | A1 | A2 | A3 | A4 | A5 |
| 33 | (none) | Ref K + Qty 5 | Std A2 | Std A3 | Std A4 | Std A5 |
| 34 | (none) | Ref K + Qty 4 | Std A2 | Std A3 | Std A4 | (none) |
| 35 | (none) | Ref K + Qty 4 | Std A2 | Std A3 | Std A4 | (none) |
| 36 | (none) | Ref K + Qty 3 | Std A2 | Std A3 | (none) | (none) |
| 37 | (none) | Ref K + Qty 4 | Std A2 | Std A3 | Std A4 | (none) |
| 38 | (none) | Ref K + Qty 3 | Std A2 | Std A3 | (none) | (none) |
| 39 | (none) | Ref K + Qty 3 | Std A2 | Std A3 | (none) | (none) |
| 40 | (none) | Ref K + Qty 2 | Std A2 | (none) | (none) | (none) |
| 41 | (none) | Ref K + Qty 4 | Std A2 | Std A3 | Std A4 | (none) |
| 42 | (none) | Ref K + Qty 3 | Std A2 | Std A3 | (none) | (none) |
| 43 | (none) | Ref K + Qty 3 | Std A2 | Std A3 | (none) | (none) |
| 44 | (none) | Ref K + Qty 2 | Std A2 | (none) | (none) | (none) |
| 45 | (none) | Ref K + Qty 3 | Std A2 | Std A3 | (none) | (none) |
| 46 | (none) | Ref K + Qty 2 | Std A2 | (none) | (none) | (none) |
| 47 | (none) | Ref K + Qty 2 | Std A2 | (none) | (none) | (none) |
| 48 | (none) | Ref K + Qty 1 | (none) | (none) | (none) | (none) |
| 49 | (none) | Ref K + Qty 4 | Std A2 | Std A3 | Std A4 | (none) |
| 50 | (none) | Ref K + Qty 3 | Std A2 | Std A3 | (none) | (none) |
| 51 | (none) | Ref K + Qty 3 | Std A2 | Std A3 | (none) | (none) |
| 52 | (none) | Ref K + Qty 2 | Std A2 | (none) | (none) | (none) |
| 53 | (none) | Ref K + Qty 3 | Std A2 | Std A3 | (none) | (none) |
| 54 | (none) | Ref K + Qty 2 | Std A2 | (none) | (none) | (none) |
| 55 | (none) | Ref K + Qty 2 | Std A2 | (none) | (none) | (none) |
| 56 | (none) | Ref K + Qty 1 | (none) | (none) | (none) | (none) |
| 57 | (none) | Ref K + Qty 3 | Std A2 | Std A3 | (none) | (none) |
| 58 | (none) | Ref K + Qty 2 | Std A2 | (none) | (none) | (none) |
| 59 | (none) | Ref K + Qty 2 | Std A2 | (none) | (none) | (none) |
| 60 | (none) | Ref K + Qty 1 | (none) | (none) | (none) | (none) |
| 61 | (none) | Ref K + Qty 2 | Std A2 | (none) | (none) | (none) |
| 62 | (none) | Ref K + Qty 1 | (none) | (none) | (none) | (none) |
| 63 | (none) | Ref K + Qty 1 | (none) | (none) | (none) | (none) |

FIG. 9

ACTIVE STATION ADAPTIVE IMAGE REGISTRATION

TECHNICAL FIELD

Embodiments are generally related to data-processing systems and methods. Embodiments are also related to electronic rendering devices and systems, such as color printers and copy machines. Embodiments are additionally related to color registration systems.

BACKGROUND OF THE INVENTION

In various reproduction systems, including xerographic printing, the control and registration of the position of imageable surfaces such as photoreceptor belts, intermediate transfer belts (if utilized), and/or images thereon, is a critical feature. It is well known to provide various single and/or dual axes control systems, for adjusting or correcting the lateral position and/or process position or timing of a photoreceptor belt or other image bearing member of a reproduction apparatus, such as by belt lateral steering systems and/or belt drive motor controls, and/or adjusting or correcting the lateral position and/or process position or timing of the placing of images on the belt with adjustable image generators such as laser beam scanners.

Color registration systems are often implemented as a part of an overall color printing system. One example of a color registration process and/or system is disclosed in U.S. Pat. No. 6,275,244 entitled "Color Printing Image Bearing Member Color Registration System," which issued to Omelchenko, et al on Aug. 14, 2001 and is assigned to the Xerox Corporation of Stamford Conn. U.S. Pat. No. 6,275,244 is incorporated herein by reference. Another example of a color registration system/process is disclosed in U.S. Pat. No. 6,300,968 entitled "Color Printing Process Direction Color Registration System With Expanded Chevrons," which issued to Kerxhalli et al on Oct. 9, 2001 and which is assigned to the Xerox Corporation of Stamford, Conn. U.S. Pat. No. 6,300,968 is incorporated herein by reference. An example of a color printing or rendering process and/or system is disclosed in U.S. Pat. No. 7,039,348, entitled "Method for Maintaining Image on Image and Image on Paper Registration," which issued to Kerxhalli et al on May 2, 2006 and which is assigned to the Xerox Corporation of Stamford, Conn. U.S. Pat. No. 7,039,348 is also incorporated herein by reference.

An important application of such accurate image position or registration systems is to accurately control the positions of different colors being printed on the same intermediate or final image substrate, to insure the positional accuracy (adjacency and/or overlapping) of the various colors being printed. That is not limited to xerographic printing systems. For example, precise registration control may be required over different ink jet printing heads and/or vacuum belt or other sheet transports in a plural color ink jet printer.

It is well known to provide image registration systems for the correct and accurate alignment, relative to one another, on both axes, of different plural color images on an initial imaging bearing surface member such as (but not limited to) a photoreceptor belt of a xerographic color printer. That is, to improve the registration accuracy of such plural color images relative to one another and/or to the image bearing member, so that the different color images may be correctly and precisely positioned relative to one another and/or superposed and combined for a composite or full color image, to provide for customer-acceptable color printing on a final image substrate such as a sheet of paper. The individual primary color images to be combined for a mixed or full color image are often referred to as the color separations.

Known means for adjusting the registration of images on either or both axes (the lateral axis and/or the process direction axis) relative to the image bearing surface and one another include adjusting the position or timing of the images being formed on the image bearing surface. That may be done by control of ROS (raster output scanner) laser beams or other known latent or visible image forming systems.

In particular, it is known to provide such imaging registration systems by means of MOB ("Marks-on-Belt") systems, in which edge areas of the image bearing belt (either process or lateral direction, as described herein) outside of its normal imaging area are marked with registration positional marks, detectable by an optical sensor. For belt steering and motion registration systems (as previously described) such registration marks can be permanent, such as by silk screen printing or otherwise permanent marks on the belt, such as belt apertures, which may be readily optically detectable. However, for image position control relative to other images on the belt, or the belt position, especially for color printing, typically these registration marks are not permanent marks. Typically they are distinctive marks imaged with, and adjacent to, the respective image, and developed with the same toner or other developer material as is being used to develop the associated image, in positions corresponding to, but outside of, the image position. Such as putting the marks along the side of the image position or in the inter-image zone between the images for two consecutive prints. Such marks-on-belt (MOB) image position or registration indicia are thus typically repeatedly developed and erased in each rotation of the photoreceptor belt. It is normally undesirable, of course, for such registration marks to appear on the final prints (on the final image substrate).

It is generally well known in the art of reproduction systems that image registration control on an image bearing belt can be accomplished based on MOB sensor measurements of developed marks on the belt indicative of respective image positions on that image bearing member (substrate). If desired, that can also be combined with additional sensor information from belt edge sensing and/or permanent belt marks or holes sensing. As also noted, a printer image registration controller and/or electronic front end (EFE) can utilize MOB sensor inputs to control ROS scan lines positioning on the photoreceptor (PR) surface to correct registration of the respective image positions on both axes. That is, without necessarily requiring MOB sensor interaction with, or control over, the PR drive or PR steering controls for process direction or lateral direction registration. However, such PR registration movement, instead of, or in addition to, such imaging position registration movement, can also be accomplished if desired.

A direct sensing of the surface motion of image receivers, such as photoreceptor belts or intermediate transfer belts, or other substrates, enables more precise transport and/or image registration, for superior image quality. In contrast, a principle method of accurately sensing photoreceptor belt motion in the process direction in present practice for xerographic printers is to use a relatively expensive precision machined encoder roll in contact with the back surface of the belt (or on the drive shaft of the belt drive). The encoder roll may be coupled to a rotary shaft encoder with an anti-rotational coupling that helps avoid errors from misalignment. Motion sensing errors that can contribute to errors in color registration systems with such belt-driven encoder sensors can come from encoder roll eccentricity, rotary encoder accuracy (once per roll revolution errors) as well as errors from belt slip, belt stretch, and belt thickness variations. The once per encoder roll revolution type errors may be addressed by employing design rules that locate marking elements spaced apart at integer numbers of encoder roll revolutions, to synchronize the errors between color separations. However, this imposes disadvantageous machine architecture and physical size constraints. Avoiding those constraints could enable smaller size/height machines, or location of multiple image stations on the same side of a photoreceptor belt module, which in turn enables avoidance of other errors that can be encountered when locating imagers on both sides of a belt module.

Low frequency process direction movement errors, such as once per belt revolution, or other errors that accumulate in transporting the belt for multiple images, may be invisible to encoder roll registration controls. This is primarily attributed to belt thickness variations caused by the encoder roll sensing the belt from the backside with the belt flowing over this roll in a wrap condition. Advantages of the subject position measurement system include eliminating such error sources and thus improving registration. By directly measuring the belt surface position with a high degree of accuracy, those sensor signals can be inputted into an agile beam imager, such as the variable imaging position ROS systems shown in FIG. 1 to implement a printing system that can allow relaxation of motion control requirements or tolerances for the belt surface, and potentially eliminating the need for an expensive precision belt movement rotary encoder and its circuitry.

Color registration systems for printing, as here, should not be confused with various color correction or calibration systems, involving various color space systems, conversions, or values, such as color intensity, density, hue, saturation, luminance, chrominance, or the like, as to which respective colors may be controlled or adjusted. Color registration systems, such as that discussed herein, relate to positional information and positional correction (shifting respective color images laterally or in the process direction and/or providing image rotation and/or image magnification) so that different colors may be accurately superposed or interposed for customer-acceptable full color or intermixed color or accurately adjacent color printed images. The human eye is particularly sensitive to small printed color mis-registrations of one color relative to one another in superposed or closely adjacent images, which can cause highly visible color printing defects such as color bleeds, non-trappings (white spaces between colors), halos, ghost images, etc.

Image registration in the context of rendering systems, such as color printers, requires ensembles of chevron marks to be written on a photoreceptor or intermediate belt. These chevron ensembles can be detected by the MOB sensors described above. In order to correctly process the chevron ensemble data, image registration controller software is employed, which expects the chevron ensembles to contain a fixed number of marks in a set color order.

In many xerographic printers, low toner throughout can cause significant aging of the materials in the developer housing because the housing is churning the same material repetitively. The desired state is to disable developer housings that are not being used in order to preserve the materials. In this case, an image registration system cannot measure color-to-color registration properly because it expects a specific pattern of chevron marks.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the present invention to provide for improved data-processing systems and methods.

It is another aspect of the present invention to provide for an improved color registration method and system.

The aforementioned aspects and other objectives and advantages can now be achieved as described herein. A color registration method, system, and computer program product are disclosed herein. Such a color registration system generally includes a plurality of imaging stations and one or more MOB (Marks-On Belt) sensors. An indication is initially provided to each imaging station among the imaging stations, which colors among a plurality of colors associated with said color registration system are active. Next, an arbitrary imaging station among the imaging stations can be assigned as a reference color. Thereafter, the arbitrary imaging station can be instructed to write an appropriate color pattern to replace marks associated with any imaging among imaging stations not enabled with the marks with respect to said reference color in order to thereby produce a resulting color ensemble that is detectable by one or more MOB sensors.

One method of color registration sensing relates to developing and then detecting a multicolor chevron pattern on a photoreceptor. In some new architectures, it is desirable to completely disable one color marker; thus the portion of the chevron pattern of that color cannot be produced. The methodology and system described above therefore overcomes the absence of one or more chevron colors so that the sensing software need not be changed. The basic concept of such an improvement involves printing the "missing" color(s) in another color. This will allow the hardware chevron sensor to continue to operate as before since no chevron bars will be missing and timing is unaffected. The resulting advantage includes simplicity and low cost because software changes are not required.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

FIG. 7 illustrates a table depicting data with respect to software that determines which physical stations are active, in accordance with an alternative embodiment;

FIG. 8 illustrates a table depicting data with respect to software mapping of active station assignments to physical stations, in accordance with an alternative embodiment;

FIG. 9 illustrates a table depicting data with respect to software that determines which chevron cursor is to be written by a corresponding active station, in accordance with an alternative embodiment.

DETAILED DESCRIPTION

The particular values and configurations discussed in these non-limiting examples can be varied and are cited merely to illustrate at least one embodiment and are not intended to limit the scope thereof.

Figure 1:
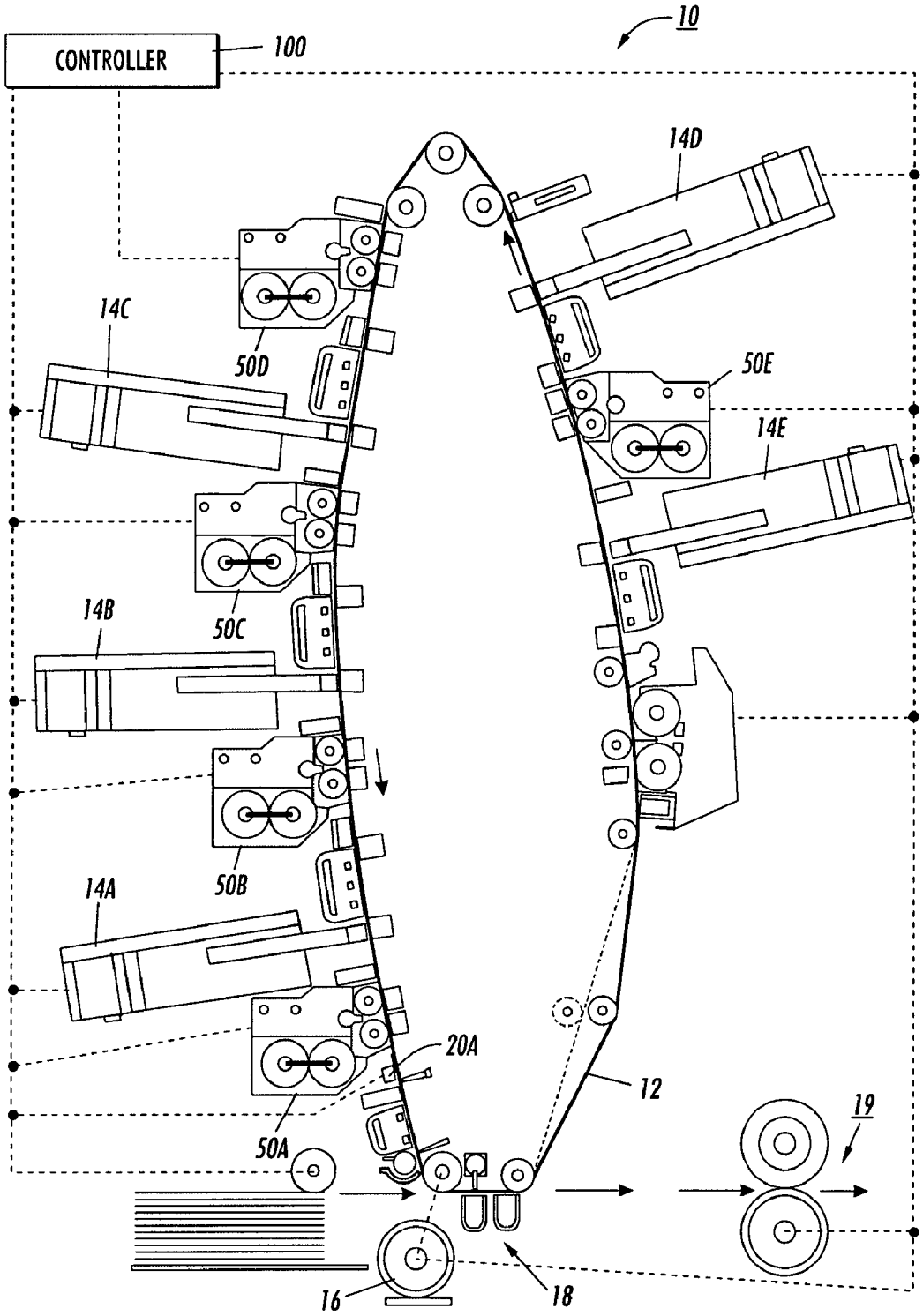
FIG. 1 is a schematic frontal view of one example of a reproduction system for incorporating one example of the subject registration system, in this case, a color-on-color xerographic printer.

FIG. 1 schematically illustrates a, printer 10 as one example of an otherwise known type of xerographic, plural color "image-on-image" (IOI) type full color (cyan, magenta, yellow and black imagers) reproduction machine, merely by way of one example of the applicability of the current cursor correction system. A partial, very simplified, schematic perspective view thereof is provided in FIG. 2. This particular type of printing is also referred as "single pass" multiple exposure color printing. It has plural sequential ROS beam sweep PR image formations and sequential superposed developments of those latent images with primary color toners, interspersed with PR belt re-charging.

However, it will be appreciated that the disclosed improved registration system could also be employed in non-xerographic color printers, such as ink jet printers, or in "tandem" xerographic or other color printing systems, typically having plural print engines transferring respective colors sequentially to an intermediate image transfer belt and then to the final substrate. Thus, for a tandem color printer it will be appreciated the image bearing member on which the subject registration marks are formed may be either or both on the photoreceptors and the intermediate transfer belt, and have MOB sensors and image position correction systems appropriately associated therewith. Various such known types of color printers are further described in the above-cited patents and need not be further discussed herein.

Figure 2:
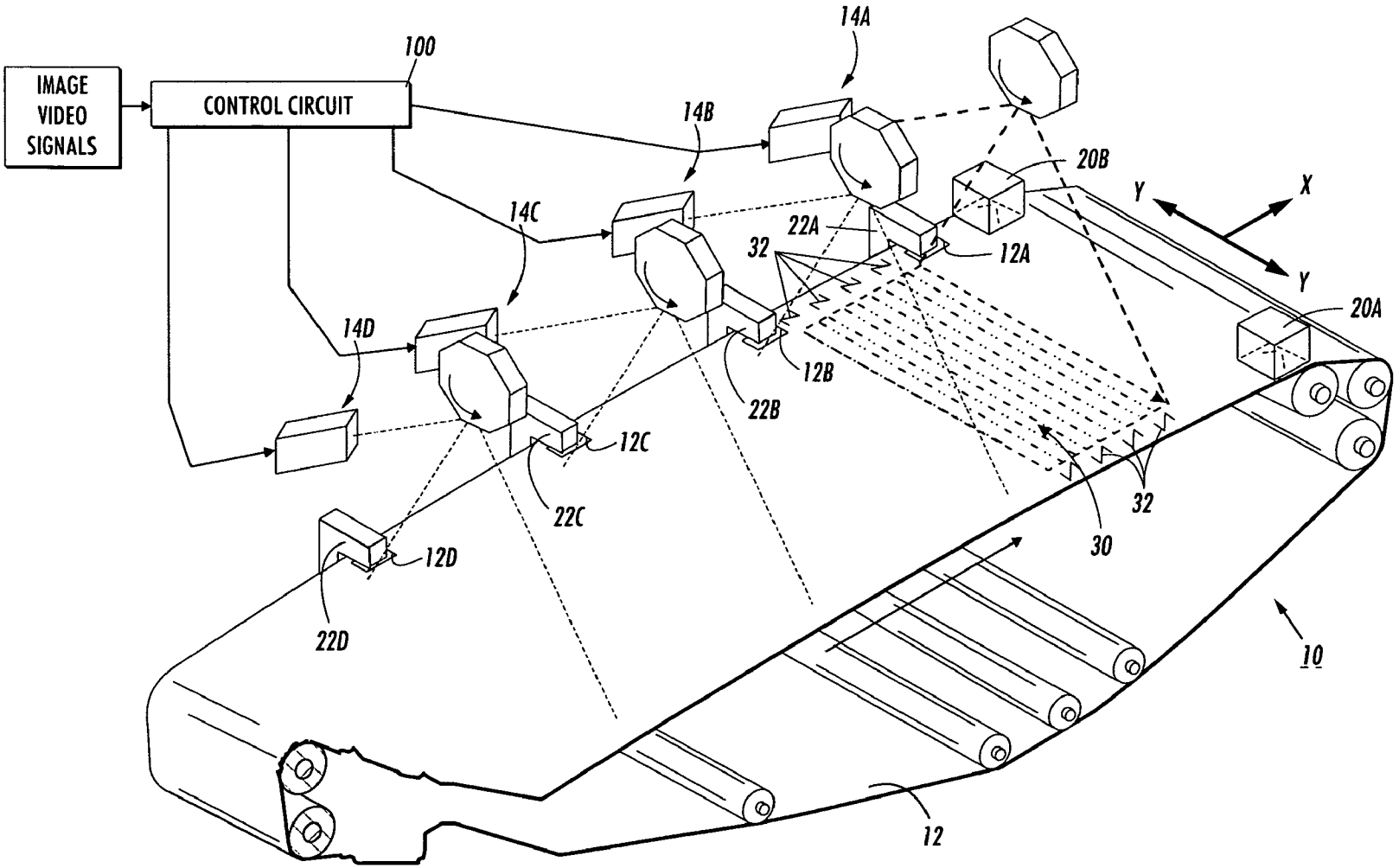
FIG. 2 is a simplified schematic perspective view of part of the embodiment of FIG. 1 for better illustrating exemplary sequential ROS generation of plural color latent images and associated exemplary latent image registration marks for MOB sensing (with development stations, etc., removed for illustrative clarity)

Referring to the exemplary rendering device or printer 10 of FIGS. 1 and 2, all of its operations and functions may be controlled by programmed microprocessors, as described above, at centralized, distributed, or remote system-server locations, any of which are schematically illustrated here by the control circuit or controller 50. A single photoreceptor belt 12 may be successively charged, ROS (raster output scanner) imaged, and developed with black or any or all primary colors toners by a plurality of imaging stations. In this example, these plural imaging stations include respective ROS's 14A, 14B, 14C, 14D, and 14E; and associated developer units 50A, 50B, 50C, 50D, and 50E. A composite plural color imaged area 30, as shown in FIG. 2, may thus be formed in each desired image area in a single revolution of the belt 12 with this exemplary printer 10, providing accurate registration can be obtained. Two MOB sensors (20A in FIG. 1, 20A and 20B in FIG. 2) are schematically illustrated, and will be further described herein concerning such registration.

In embodiments, developer units 50A-D can be utilized to develop black, cyan, yellow, and magenta, respectively. These images are developed successively on the photoreceptor belt before being transferred to a sheet of paper. The belt 12 can be equipped with a conventional drive system 16 for moving it in the process direction shown by its movement arrows. A conventional transfer station 18 is illustrated for the transfer of the composite color images to the final substrate, usually a paper sheet, which then is fed to a fuser 19 and outputted.

Referring to FIG. 2, it may be seen that registration holes 12A, 12B, 12C, 12D, etc., (or other permanent belt marks, of various desired configurations) may also be provided along one or both edges of the photoreceptor belt 12. These holes or marks may be optically detected, such as by belt hole sensors, schematically shown in this example in FIG. 2 as 22A, 22B, 22C, 22D. Various possible functions thereof are described, for example, in the above-cited patents. If desired, the holes or other permanent belt markings may be located, as shown, adjacent respective image areas, but it is not necessary that there be such a mark for each image position, or plural sensors. Also, the number, size and spacing of the image areas along the photoreceptor belt may vary in response to various factors including, for example, when larger or smaller images are being printed.

In FIG. 2 it may be seen that toner registration mark images 32 have been formed along both sides of the printer 10 photoreceptor belt 12, adjacent but outside of its imaged area 30, as will be further described. However, those "Z" marks 32 can be replaced with chevron-shaped toner registration mark images 34A F, such as those described herein, or expanded chevrons as shown and described in U.S. Pat. No. 6,300,968, issued Oct. 9, 2001 (the '968 patent). Examples of other types of MOB are given in the '968 patent as well. The particular shape of the marks is not important to the present invention. These marks are used to ensure that images drawn on the belt at different stations are aligned with each other, and particularly to ensure that each color is drawn in the appropriate place. When printing multi-color documents it is important to keep the colors aligned.

MOB registration marks corresponding to different toner colors can be imaged and developed in close alignment both with respect to each other and with respect to the MOB sensors 20A, 20B. U.S. Pat. No. 6,275,244, for example, discloses an exemplary image-on-image (IOI), or color on color, registration setup system, the subject matter of which has already been incorporated in its entirety. The IOI registration setup aligns the MOB registration marks 32 along the sides of the belt with the MOB sensors 20A, 20B. After IOI registration setup has been performed, all the colors—magenta, yellow, cyan, and black—are aligned to each other, and the MOB registration marks are centered under the MOB sensors. An exemplary registration system includes the following elements: an initial image registration or setup mode, an expanded chevron registration mode, and a standard regular or fine registration mode.

The disclosed embodiments generally illustrate a process/system for enabling image registration control for any combination of two or more colors. Image registration control software can be provided, which indicates to each imaging station which colors are active. Such software can be provided as, for example, one or more software modules (e.g., see module 1007 with respect to FIG. 10). Such software can assign an arbitrary station as the reference color. The station assigned as the reference color is then instructed by the software to write the appropriate chevron pattern, in order to replace the marks for any station that is not enabled with marks for the reference color. The resulting chevron ensemble can then be detected by the MOB sensors in exactly the same manner as when all colors are present (since the MOB sensors cannot detect color, they only detect the presence of color). The image registration control software can then utilize only the data that applies to the colors that are present. The disclosed embodiments permit the system to avoid using complicated timing windows in order to avoid missing colors in the MOB sensor processing software. Such a technique permits using the same processing routines as in current rendering devices in order to detect and measure color registration.

Figure 3:
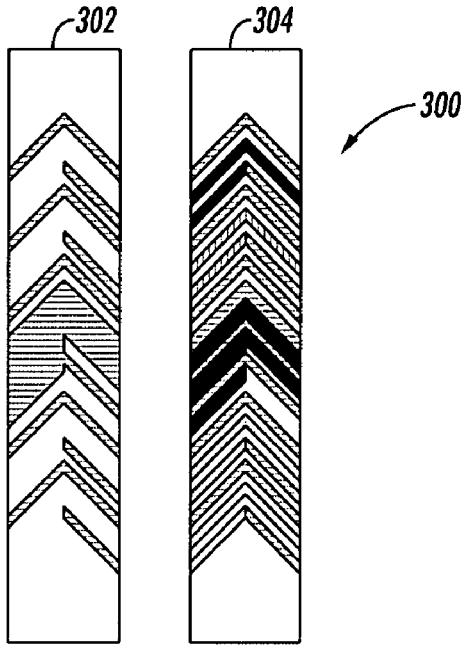
FIG. 3 illustrates an example of a reference color RIM cursor and a resulting 6-color chevron ensemble in accordance with a preferred embodiment.

FIG. 3 illustrates an example of a typical multi-colored chevron ensemble 100, which can be implemented in accordance with a preferred embodiment. The example ensemble 100 depicted in FIG. 3 is based on the Cayman program, which is a six color machine. The technique disclosed herein can be adapted for use with any multi-color machine regardless of the number of colors. A bitmap pattern can be stored on an ROS Interface Module (RIM) for each station. Such bitmaps can be referred to as RIM cursors in some applications. Each station generally writes an RIM cursor containing the appropriate placement of chevron marks. When the RIM cursors are overlaid on a photoreceptor or IBT, the resulting ensemble appears similar to the configuration depicted in FIG. 3. In the example depicted in FIG. 3, the cyan color is considered to be the reference color. The ensemble 100 depicted in FIG. 3 thus illustrates a reference color RIM cursor 102 and a resulting 6-color chevron ensemble 104 in accordance with a preferred embodiment.

Figure 4:
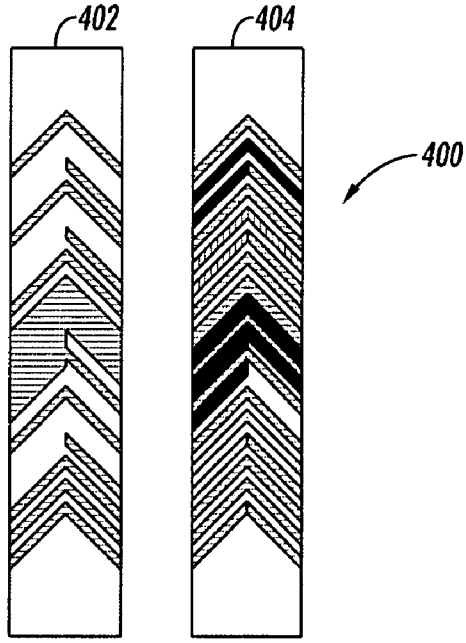
FIG. 4 illustrates an example of a 6-color machine of reference color RIM color for K+4 colors (green unavailable) and a resulting 5-color chevron ensemble in accordance with an alternative embodiment.

FIG. 4 illustrates an example of an arrangement 400 indicative of an ensemble 402 based on a 6-color machine of reference color RIM color for K+4 colors (green unavailable) and a resulting 5-color chevron ensemble 404 in accordance with an alternative embodiment. If the system were to require that the green station be disabled, then the cyan station would choose a different RIM Cursor containing an alternate chevron pattern in order to replace the missing green marks. This new cyan cursor and the resulting 5 color chevron ensemble are depicted in FIG. 4. The MOB sensors (e.g., 20A in FIG. 1, 20A and 20B in FIG. 2) discussed earlier can detect the same number of marks with the chevron ensemble depicted in FIG. 4 as they can for the chevron ensemble in FIG. 3. Therefore, the color registration time-stamps generated by the MOB sensors can be analyzed by the software in the same manner for the ensembles in FIGS. 3 and 4.

This logic can apply with respect to any of the missing colors by simply replacing the missing marks with whatever color is assigned the reference color. The reference color can be assigned to any station except the station containing black toner, since the MOB Sensors cannot detect black (black requires a "floodfilled" chevron which can be seen in FIGS. 3 and 4 where the black toner is written over the reference color toner). The MOB sensors can detect the reference color toner and then infer the location of the black marks. However, if the sensors can detect black, then the same concept can be applicable and black can be used as the reference color. The disclosed embodiments preferably require that multiple chevron cursors be stored in a memory location associated with each RIM, or at least that the RIM can dynamically switch RIM Cursors while running (i.e. cursor bitmaps are pulled from a hard drive). Current rendering devices and hardware possess enough memory to store these chevron cursors.

Figure 5:
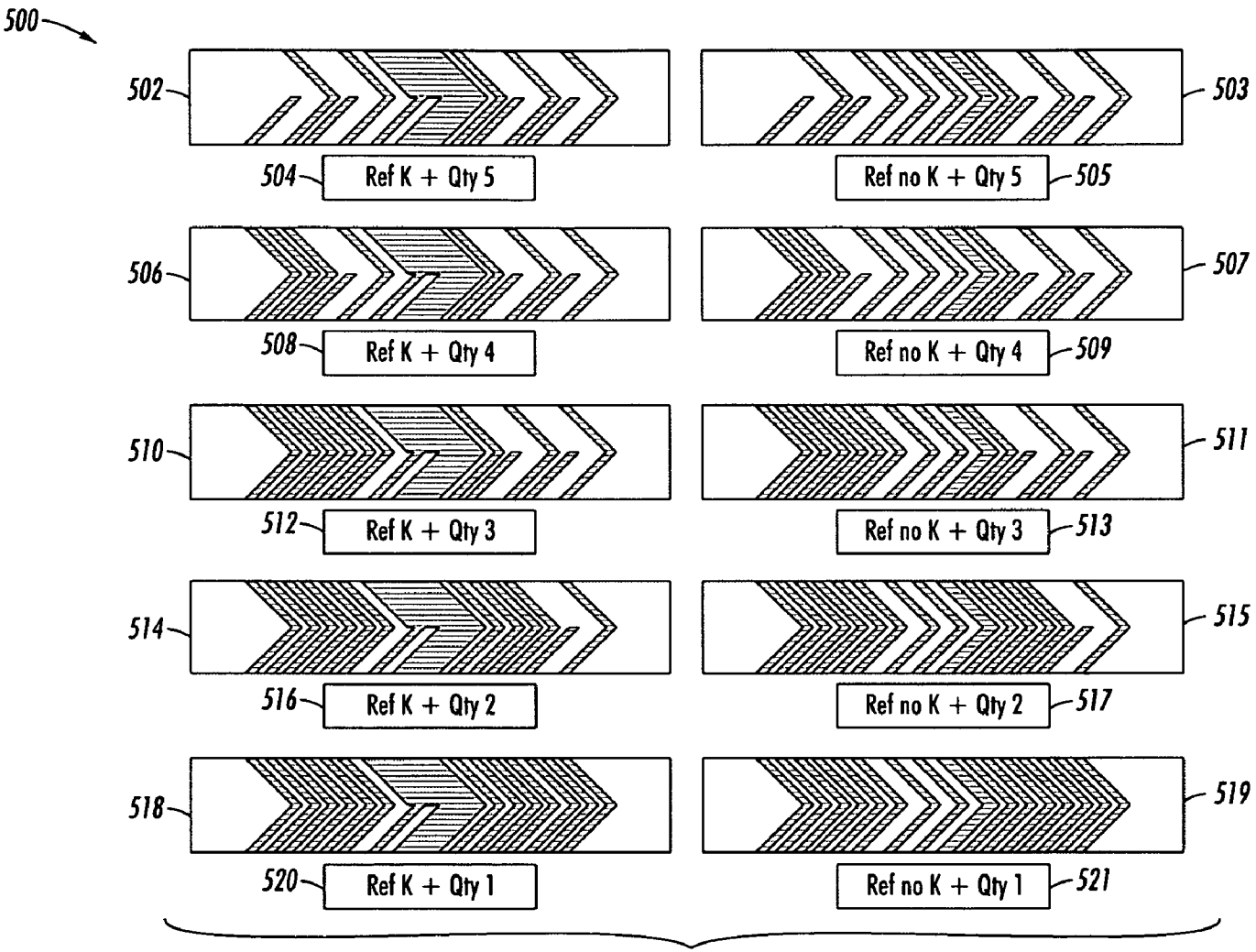
FIG. 5 illustrates reference chevrons to be stored on each RIM, in accordance with an alternative embodiment.

FIG. 5 illustrates a configuration 500 of reference chevrons to be stored on each RIM in accordance with an alternative embodiment. In the configuration 500 depicted in FIG. 5, chevrons 502, 506, 510, 514, and 518 are respectively associated with the mathematical operations depicted at blocks 504, 508, 512, 516, and 520. Similarly, chevrons 503, 507, 511, 515, and 519 are respectively associated with the mathematical operations shown at blocks 505, 509, 513, 517 and 521.

Figure 6:
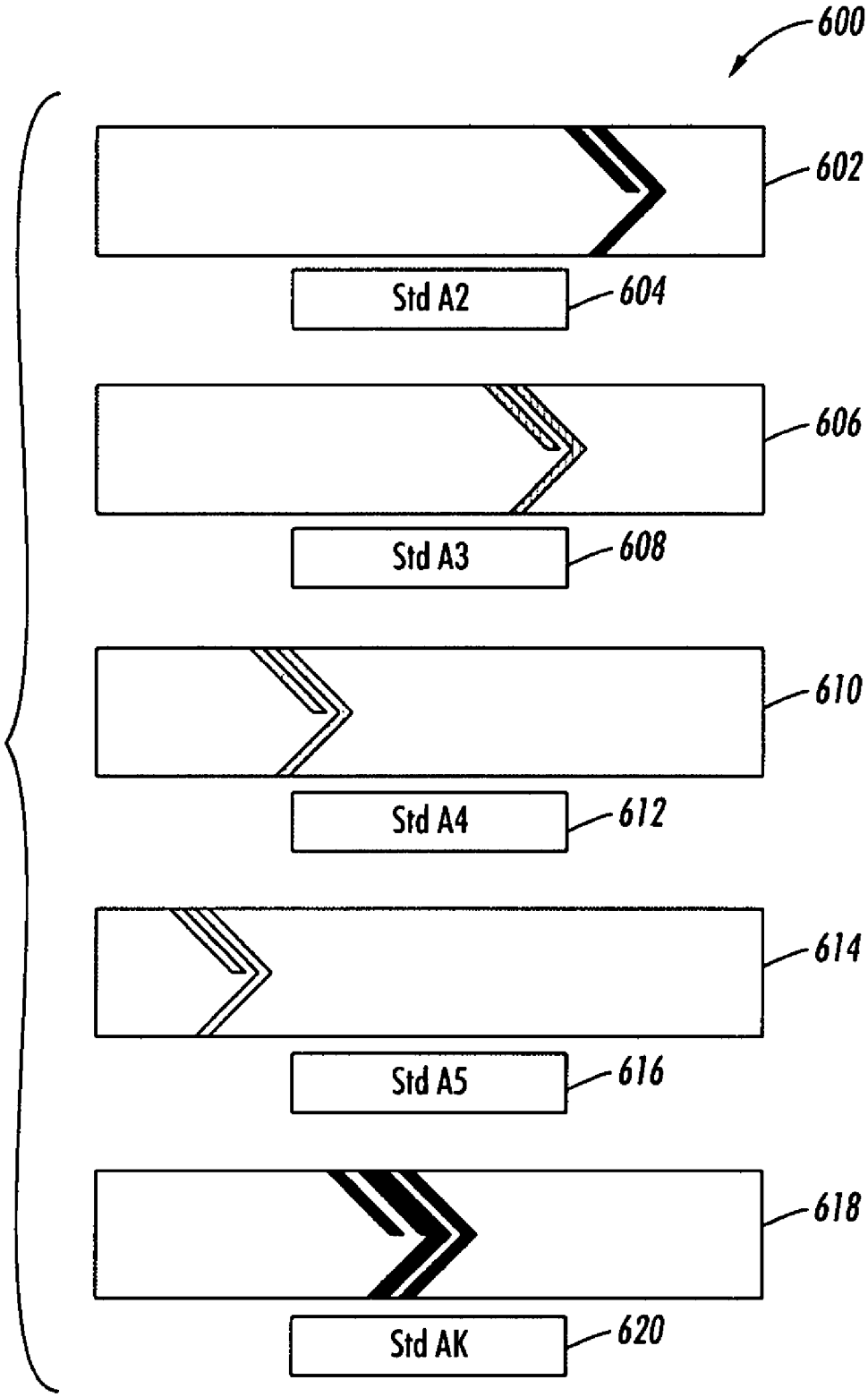
FIG. 6 illustrates active station non-reference chevron cursors, in accordance with an alternative embodiment.

FIG. 6 illustrates a configuration 600 active station non-reference chevron cursors, in accordance with an alternative embodiment. Configuration 600 depicted in FIG. 6 generally illustrates chevrons 602, 606, 610, 614, and 618 with respect to mathematical and/or software operations depicted at blocks 604, 608, 612, 616, and 620.

FIG. 7 illustrates a table 700 depicting data with respect to software that determines which physical stations are active, in accordance with an alternative embodiment. FIG. 8 illustrates a table 800 depicting data with respect to software mapping of active station assignments to physical stations, in accordance with an alternative embodiment. Finally, FIG. 9 illustrates a table 900 depicting data with respect to software that determines which chevron cursor is to be written by a corresponding active station, in accordance with an alternative embodiment.

A number of high-level implementations can be provided, depending on the design goals of a particular embodiment. For example, software can be utilized to designate physical stations, such as: PK (black), PA (cyan), PB (yellow), PC (magenta), PD (custom #1), and PE (custom #2). The software can be configured, for example, to determine which physical stations are active as illustrated in Table 700 depicted in FIG. 7. Software generally maps active stations to corresponding physical stations as depicted in the example illustrated in Table 800 in FIG. 9 with the following example parameters:

AK (if black is turned on)
A1 ($1^{st}$ active non-black station)
A2 ($2^{nd}$ active non-black station)
A3 ($3^{rd}$ active non-black station)
A4 ($4^{th}$ active non-black station)
A5 ($5^{th}$ active non-black station)

The software indicates to each active station RIM which Chevron Cursor to write as in Table 800 depicted in FIG. 8. Example chevron cursor sketches are illustrated in FIGS. 5-6. It is suggested that the color of the Chevrons in FIGS. 5-6 be disregarded The RIM has a Chevron Cursor bitmap, but the resulting color will depend upon which Physical Station is writing the Chevron Cursor (Table 800 depicted in FIG. 8). In general, the MOB Sensors read Chevron ensembles. Image registration control software utilizes only MOB data assigned to Active Stations. Mapping to Physical Stations can be used to determine which actuators to adjust.

The disclosed embodiments enable the ability to cycle down stations that are not being used and while registering the colors that are enabled. Additionally, a more consistent IQ can be provided by not aging materials. Implementation of the disclosed embodiments can also result in a lower cost per print by not printing patches for colors with low area coverage, and a lower cost for customer because materials will need to be changed less often. Implementation is straight-forward in that it does not require the MOB Sensor electronics to "know" which colors are enabled and create timing windows and algorithms to ignore missing colors. Additionally, the disclosed embodiments can minimize the number of different test patterns required without needing complicated algorithms. Software also utilizes the same basic algorithms that are currently used to process MOB Sensor data and measure color to color registration. Finally, the embodiments can be utilized to enable color registration for a multi-color machine beyond 4 colors (e.g., 6 colors). Some customers may only want or need a single color beyond CMYK.

Figure 10:
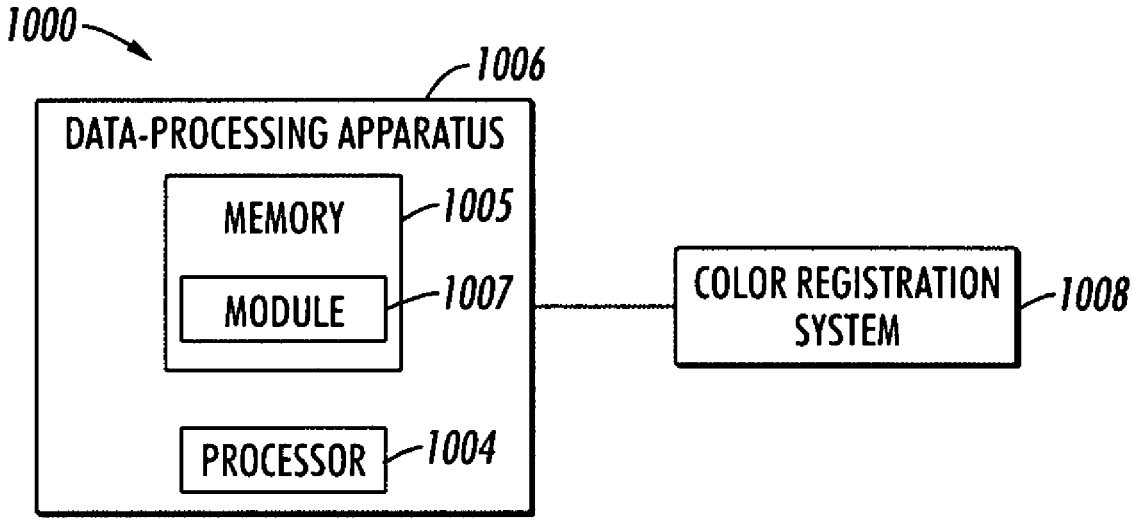
FIG. 10 illustrates a data-processing system composed of a color registration system and a data-processing apparatus, in accordance with a preferred embodiment.

FIG. 10 illustrates a data-processing system 1000 composed of a color registration system 1008 and a data-processing apparatus 1006, in accordance with a preferred embodiment. Data-processing apparatus 1006 can be implemented as a computer, such as, but not limited to, a computer server, a network of computer servers, a desk-top computer, a laptop computer, and so forth. In general, data-processing apparatus 1006 includes a memory 1005 and a processor 1004. Data-processing apparatus 1006 represents one of many possible data-processing and/or computing devices, which can be utilized in accordance with the disclosed embodiments. It can be appreciated that data-processing apparatus 1006 and its components are presented for generally illustrative purposes only and do not constitute limiting features of the disclosed embodiments. Data-processing apparatus can communicate with a color registration system 1008, such as the color registration systems described earlier.

System 1000 can include the use of one or more "modules" such as, for example, module 1007 which can be stored in memory 1005 of the data-processing apparatus 1006. The embodiments described herein can be implemented in the context of a host operating system and one or more such modules. Such modules may constitute hardware modules, such as, for example, electronic components of a computer system. Such modules may also constitute software modules. In the computer programming arts, a software "module" can be typically implemented as a collection of routines and data structures that performs particular tasks or implements a particular abstract data type.

Software modules generally include instruction media storable within a memory location of a data-processing apparatus and are typically composed of two parts. First, a software module may list the constants, data types, variable, routines and the like that can be accessed by other modules or routines. Second, a software module can be configured as an implementation, which can be private (i.e., accessible perhaps only to the module), and that contains the source code that actually implements the routines or subroutines upon which the module is based. The term "module" as utilized herein can therefore generally refer to software modules or implementations thereof. Such modules can be utilized separately or together to form a program product that can be implemented through signal-bearing media, including transmission media and/or recordable media. In general, module 1007 can constitute a computer program product for color registration that includes a computer-readable storage medium having computer-readable program code means embodied in the medium for performing particular color registration tasks and instructions as discussed herein with respect to FIGS. 1-9.

It is important to note that, although the embodiments are described in the context of a fully functional data-processing system (e.g., a computer system such as data-processing apparatus 1006), those skilled in the art will appreciate that the mechanisms of the embodiments are capable of being distributed as a program product in a variety of forms, and that the present invention applies equally regardless of the particular type of signal-bearing media utilized to actually carry out the distribution. Examples of signal bearing media include, but are not limited to, recordable-type media such as floppy disks or CD ROMs and transmission-type media such as analogue or digital communications links. The logical operation steps described herein, for example, can be implemented in the context of a software module such as 1007.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A color registration method, comprising:

indicating to each imaging station among a plurality of imaging stations of a color registration system having at least one MOB (Marks-on-Belt) sensor, which colors among a plurality of colors associated with said color registration system are active;

assigning an arbitrary imaging station among said plurality of imaging stations as a reference color; and thereafter instructing said arbitrary imaging station to write an appropriate color pattern to replace marks associated with any imaging station among said plurality of imaging stations not enabled with marks with respect to said reference color in order to thereby produce a resulting color ensemble that is detectable by said at least one MOB sensor.

2. The method of claim 1 wherein indicating to each imaging station among a plurality of imaging stations of a color registration system having at least one MOB (Marks-on-Belt) sensor, which colors among a plurality of colors associated with said color registration system are active, further comprises:

identifying physical stations among said plurality of imaging stations; and determining which of said physical stations are active; and thereafter mapping active stations among said plurality of imaging stations to said determined physical stations.

3. The method of claim 1 further comprising permitting said color registration to resister any combination of colors in response to instructing said arbitrary imaging station to write an appropriate color pattern to replace marks associated with any imaging among said plurality of imaging stations not enabled with marks with respect to said reference color.

4. The method of claim 1 wherein said marks comprise chevron marks.

5. The method of claim 1 wherein said color pattern comprises a chevron pattern.

6. The method of claim 1 wherein said color ensemble comprises a multi-colored ensemble.

7. A computer implemented system for color registration, comprising:

a data-processing apparatus;

a module executed by said data-processing apparatus, said module and said data-processing apparatus being operable in combination with one another to:

indicate to each imaging station among a plurality of imaging stations of a color registration system having at least one MOB (Marks-on-Belt) sensor, which colors among a plurality of colors associated with said color registration system are active;

assign an arbitrary imaging station among said plurality of imaging stations as a reference color; and instruct said arbitrary imaging station to write an appropriate color pattern to replace marks associated with any imaging station among said plurality of imaging stations not enabled with marks with respect to said reference color in order to thereby produce a resulting color ensemble that is detectable by said at least one MOB sensor.

8. The system of claim 7 wherein said module and said data-processing apparatus are further operable in combination with one another to:

identify physical stations among said plurality of imaging stations; and determine which of said physical stations are active; and map active stations among said plurality of imaging stations to said determined physical stations.

9. The system of claim 7 wherein said module and said data-processing apparatus are further operable in combination with one another to permit said color registration to resister any combination of colors in response to instructing said arbitrary imaging station to write an appropriate color pattern to replace marks associated with any imaging among said plurality of imaging stations not enabled with marks with respect to said reference color.

10. The system of claim 7 wherein said marks comprise chevron marks.

11. The system of claim 7 wherein said color pattern comprises a chevron pattern.

12. The system of claim 7 wherein said color ensemble comprises a multi-colored ensemble.

13. A computer program product for color registration, comprising:

a computer-readable storage medium having computer-readable program code means embodied in said medium, said computer-readable program code means comprising:

computer-readable program code means for indicating to each imaging station among a plurality of imaging stations of a color registration system having at least one MOB (Marks-on-Belt) sensor, which colors among a plurality of colors associated with said color registration system are active;

computer-readable program code means for assigning an arbitrary imaging station among said plurality of imaging stations as a reference color; and computer-readable program code means for thereafter instructing said arbitrary imaging station to write an appropriate color pattern to replace marks associated with any imaging station among said plurality of imaging stations not enabled with marks with respect to said reference color in order to thereby produce a resulting color ensemble that is detectable by said at least one MOB sensor.

14. The computer program product of claim 13 wherein said computer-readable program code means for indicating to each imaging station among a plurality of imaging stations of a color registration system having at least one MOB (Marks-on-Belt) sensor, which colors among a plurality of colors associated with said color registration system are active, further comprising:

computer-readable program code means for identifying physical stations among said plurality of imaging stations; and computer-readable program code means for determining which of said physical stations are active; and computer-readable program code means for thereafter mapping active stations among said plurality of imaging stations to said determined physical stations.

15. The computer program product of claim 13 further comprising computer-readable program code means for permitting said color registration to resister any combination of colors in response to instructing said arbitrary imaging station to write an appropriate color pattern to replace marks associated with any imaging among said plurality of imaging stations not enabled with marks with respect to said reference color.

16. The computer program product of claim 13 wherein said marks comprise chevron marks.

17. The computer program product of claim 13 wherein said color pattern comprises a chevron pattern.

18. The computer program product of claim 1 wherein said color ensemble comprises a multi-colored ensemble.

* * * * *